United States Patent [19]

Roy et al.

[11] 4,274,316

[45] Jun. 23, 1981

[54] CRANK PRESS BLANK HOLDER AND STRIPPER MECHANISM

[75] Inventors: Donald A. Roy, Waterbury; George F. O'Keefe, Southington; Carl R. Kutelis, Bristol, all of Conn.

[73] Assignee: Textron, Inc., Cheshire, Conn.

[21] Appl. No.: 119,118

[22] Filed: Feb. 6, 1980

[51] Int. Cl.[3] ..... B21D 45/08

[52] U.S. Cl. ..... 83/23; 83/132; 83/135; 83/389

[58] Field of Search ..... 83/132, 135, 389, 108, 83/23; 72/345, 346

[56] References Cited

U.S. PATENT DOCUMENTS

| | | | |
|---|---|---|---|
| 131,004 | 9/1872 | Huntington | 83/135 |
| 3,699,882 | 10/1972 | Keithley | 83/135 X |

*Primary Examiner*—J. M. Meister

*Attorney, Agent, or Firm*—De Lio and Montgomery

[57] ABSTRACT

A mechanism for use in a multi-station crank press, and the method of operating said mechanism wherein the stripper sleeves at each station are actuated, adjustably, under the control of two cams both to hold the blanks before they are contacted by the punches and to strip the blanks from the punches at selected moment as they are retracting.

8 Claims, 4 Drawing Figures

CRANK PRESS BLANK HOLDER AND STRIPPER MECHANISM

This application relates to a mechanism for use in a multi-station crank press and the method of operating said mechanism whereby the stripper sleeves at each station serve both to hold the blanks before they are contacted by the punches and to strip the blanks from the punches at a selected moment as they are retracting.

The need for such a mechanism arises from the fact that, in a crank press, there is no dwell time in the cycle and the transfer fingers start returning before the punch contacts the blank. The holding of the blank by the punch sleeve before the punch contacts the blank frees the contact fingers to return for another blank while ensuring proper positioning of the blank.

It is accordingly an object of the present invention to provide a dual-drive mechanism for the stripper sleeves such that they can dwell in the blank holding position until the punches make contact with the blanks and then retract simultaneously with the punch and blank up to the stripping position, with further retraction to free the blank for transfer to the next station.

It is another object of the invention to provide for adjustment of the holding and stripping heights individually at each station.

It is a further object of the invention to provide two I-beams, independently cam operated, to actuate simultaneously all the stripper sleeves.

It is yet another object of the invention to provide certain improvements in the form, construction and arrangement of the several parts whereby the above-named and other objects may effectively be attained.

The invention accordingly comprises the several steps and the relation of one or more of such steps with respect to each of the others and the apparatus embodying features of construction, combination of elements and arrangement of parts which are adapted to effect such steps, all as exemplified in the following detailed disclosure, and the scope of the invention will be indicated in the claims.

A practical embodiment of the invention is shown in the accompanying drawings wherein.

Figure 1:
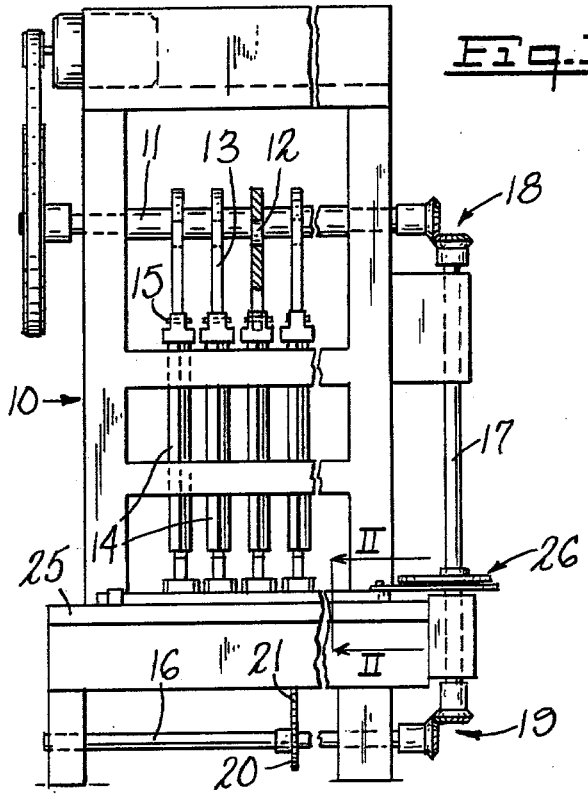
FIG. 1 represents a front elevation of a forming press in which the new mechanism is embodied, parts being broken away and parts being shown in section.
Figure 2:
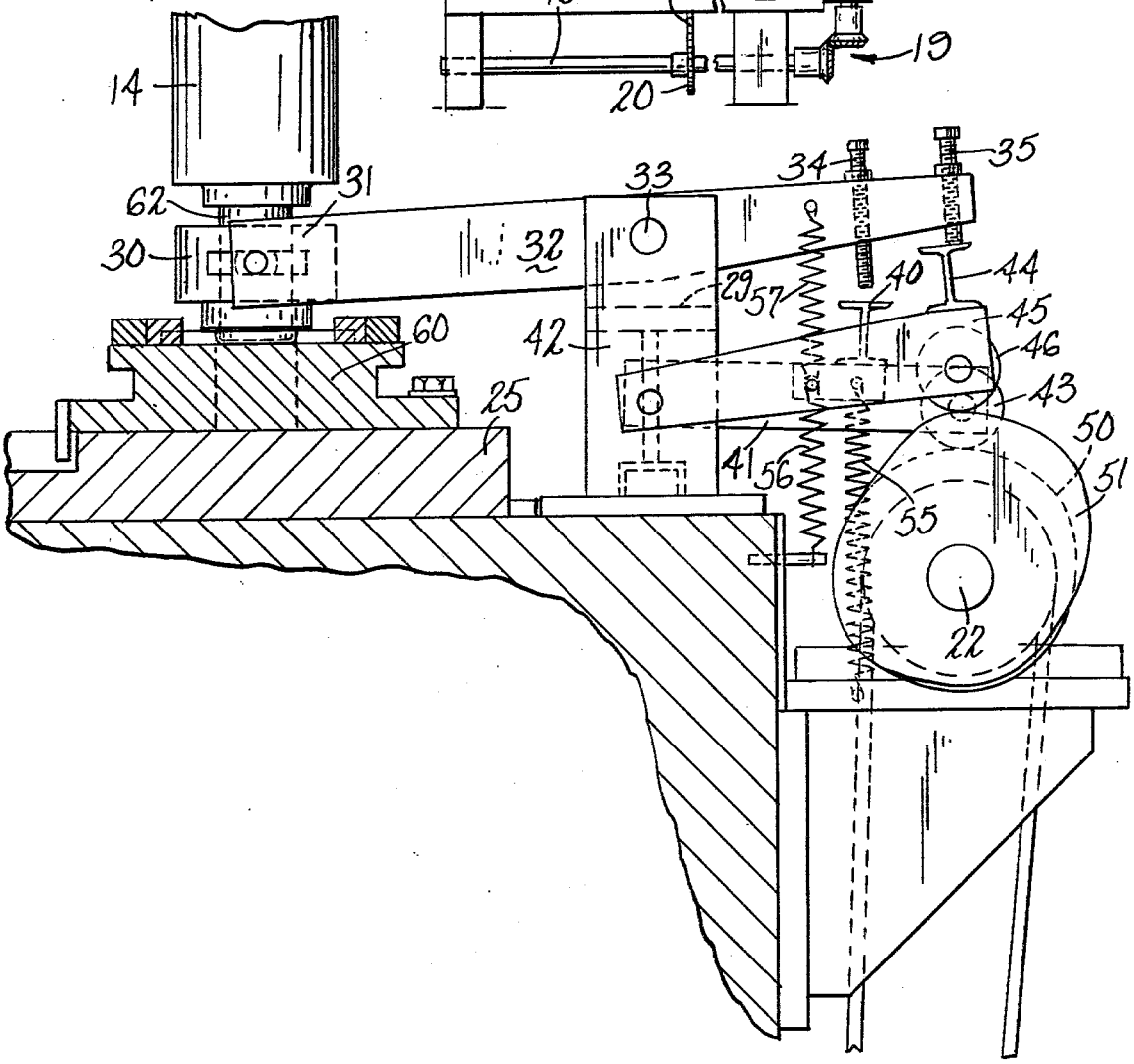
FIG. 2 represents a detail vertical section on the line II—II of FIG. 1, and on a larger scale.
Figure 3:
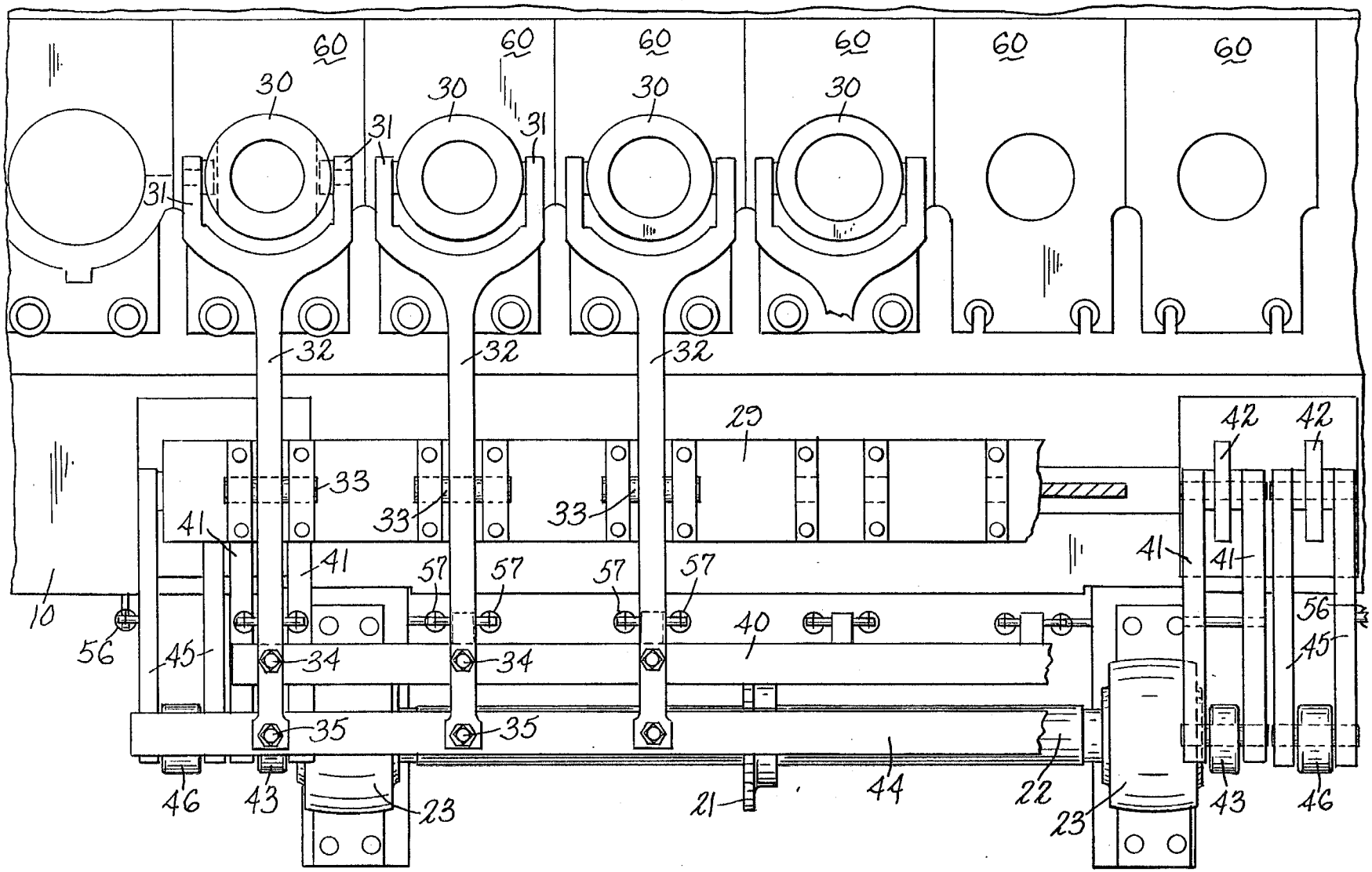
FIG. 3 represents a top plan view of the bed of the machine including the stripper levers and drive therefor, other parts being omitted or shown in section.
Figure 4:
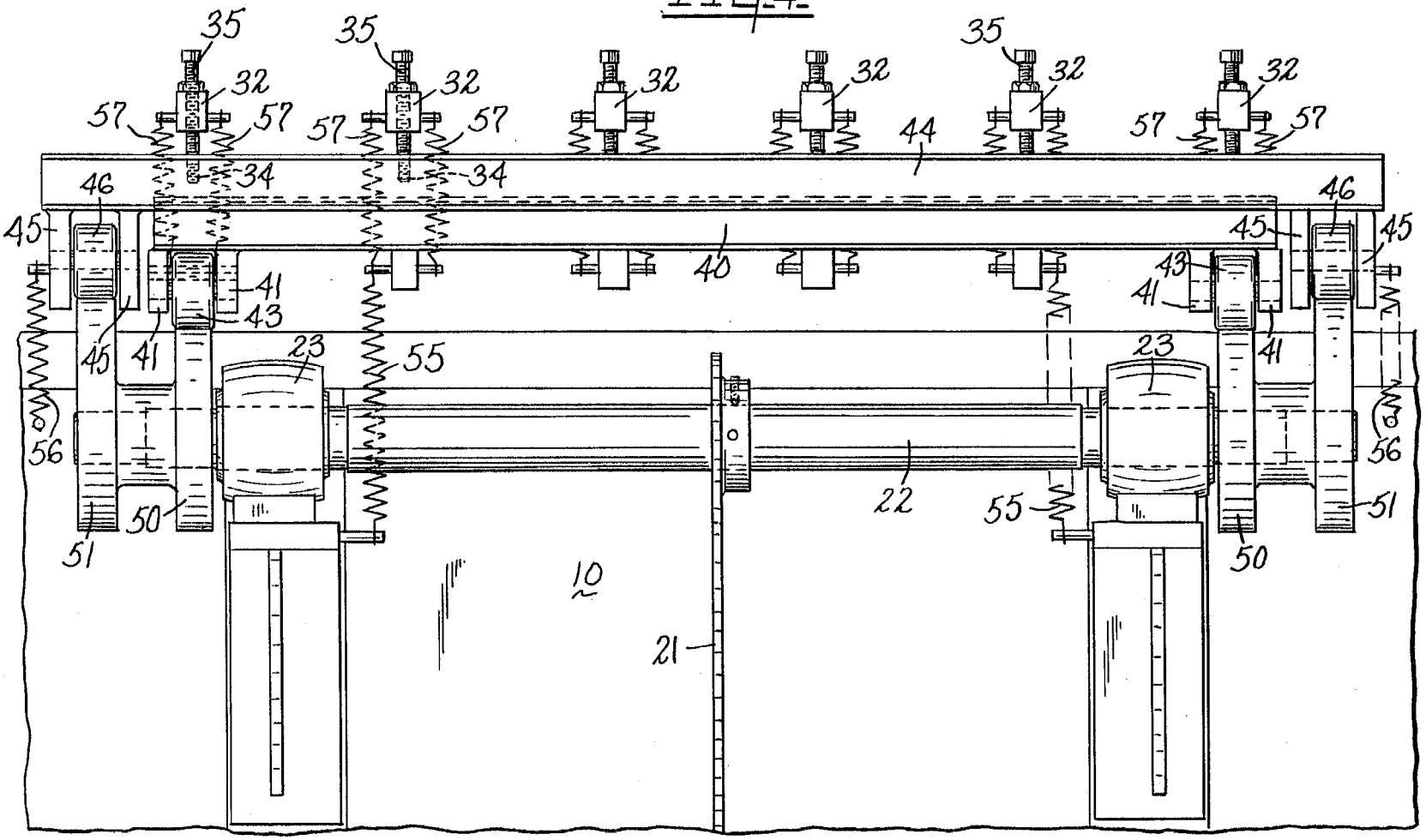
FIG. 4 represents a rear elevation of the machine, parts being broken away.

The press is shown as comprising a frame 10 in which is journaled the main drive shaft 11 (crank shaft) having eccentric bearing members 12. The connecting rods 13 are journaled on the bearing members and connected to the plungers 14 by pins 15 so that the plungers (or punch carriers) are reciprocated vertically when the drive shaft is driven. The auxillary drive shaft 16, in the base of the frame, may suitably be driven from the shaft 11 by a vertical shaft 17 having upper and lower bevel gears 18, 19, the shaft 16 carrying a sprocket 20 from which the chain 21 drives the cam shaft 22 which is journaled in bearings 23, rearwardly of the die bed 25. The transfer mechanism is driven from the shaft 17 by an eccentric indicated generally at 26.

At each station, an annular stripper sleeve 30 is carried removably and tiltably between the arms 31 of a bifurcated lever 32, pivotally mounted at 33 on a bridge 29 extending transversely of the machine. At its rear end, the lever 32 is provided with adjustable lift screws 34 and 35, spaced at different distances from the pivot point 33 and adapted to project to selected adjusted distances below the lever.

Beneath the row of screws 34 an I-beam 40 extends transversely of the machine, supported by two short cam follower levers 41, one adjacent each end of the machine, the levers being pivotally mounted on brackets 42 and provided with cam follower rolls 43. A second I-beam 44 extends transversely beneath the row of screws 35, this I-beam being supported by two short cam follower levers 45 which are also pivotally mounted on the brackets 42 and provided with cam follower rolls 46.

The cam follower rolls 43 and 46 at each end of the machine rest on cams 50, 51, respectively, which are mounted on the cam shaft 22 and driven by the chain 21, as noted above. The cam follower levers 41 are biased downwardly, for continuous contact with the cams 50, by springs 55 while the cam follower levers 45 are similarly biased downward against the cams 51 by springs 56. Each lever 32 has its rear end biased downward by a spring 57, thus ensuring that the elevation of the respective strippers 30 will remain at all times a function of the height of the I-beam 40 or I-beam 44 and the adjustment of the screws 34 and 35.

Dies 60 of suitable form are mounted on the die bed 25, in register with punches 62 on plungers or punch carriers 14, the punches being reciprocated vertically by the crank mechanism described above. Since there is no down dwell time in a crank press, the transfer fingers (not shown) at each station will start returning before the punch has contacted the blank, hence the need to hold each blank in its die by some other means. According to the present invention, the cams 51 raise the I-beam 44 into contact with the screws 35, causing the stripper sleeves 30 to hold the respective blanks from the moment of their release by the transfer finger until they are struck by the punches. This holding period corresponds to the dwell portion of the cams 51. In the next portion of the cycle, the punches, blanks and stripping sleeves retract simultaneously from the die, with the sleeves being stopped when the screws 34 come into contact with the I-beam 40, thus stripping the blanks from the punches. This stripping is effected at various heights depending on the condition of the blank at each station, the heights being determined by the adjusted positions of the respective screws 34. After the blanks have been stripped from the punches, the stripping sleeves are permitted to retract further to free the blanks for transfer to the next dies, by conventional transfer fingers.

The driving connection from the drive shaft 11 to the cam shaft 22 is positive (i.e., bevel gears and chain) so that the cam shaft, when properly adjusted, operates in synchronism with the drive shaft and punches.

The provision of a dual-cam control of the strippers in this machine enables the blanks to be held, accurately positioned relative to their respective dies, from the moment of their release by the transfer fingers to the moment of impact by the descending punches. The position of each stripper at each stage of its cycle can be accurately predetermined by adjustment of the screws 34 and 35, and variations can be effected by replacement of the cams 50 and/or 51 with cams of different profile. The press may be adapted for the formation of different products by changing the punches, dies and strippers in accordance with standard practice.

It will thus be seen that the objects set forth above, among those made apparent from the preceding description, are efficiently attained and, since certain changes may be made in the above construction and the steps of the method without departing from the spirit and scope of the invention, it is intended that all matter contained in the above description or shown in the accompanying drawings shall be interpreted as illustrative and not in a limiting sense.

We claim:

1. In a blank forming press including a frame, a vertically reciprocable plunger, a die bed positioned below said plunger, a main drive shaft rotatably mounted in said frame above said bed, said drive shaft having a crank thereon, a connecting rod actuated by said crank to impart a forming force to said plunger, a cam shaft rotatably mounted in said frame, drive means coupling said cam shaft to said drive shaft for synchronous operation therewith, a punch carried by the plunger, a stripper associated with the punch and adapted to act on a blank, a lever operative to move the stripper vertically, cam means on the cam shaft and adjustable means operatively connecting said cam means to said lever, said cam means and adjustable means being adjusted and operated to hold the stripper in blank-retaining position adjacent the die while the punch bottoms, to accompany the blank upward out of the die upon retraction of the punch and to strip the blank from the punch.

2. The press of claim 1 wherein the cam means and adjustable means include two cams on the cam shaft, two adjusting screws on the lever and means communicating movement from said cams to said screws as a function of the profiles of the cams.

3. The press of claim 1 which includes a plurality of plungers, die beds, cranks, connecting rods, punches, strippers and levers, each lever having adjustable means thereon, the cam means and adjustable means being adjusted and operated to hold each stripper in blank-retaining position adjacent its respective die while the corresponding punch bottoms, to accompany the blanks upward out of the dies and to strip the blanks from the punches.

4. The press of claim 3 wherein each lever has first and second adjustable means, all the first means being in horizontal alignment and all the second means being in horizontal alignment, a common actuating element for all the first means, a separate common actuating element for all the second means, and separate cams for positioning each of said actuating elements.

5. The press of claim 4 wherein each common actuating element is an I-beam, each I-beam being supported on cam follower levers and movable into contact with a respective line of adjustable means.

6. The press of claims 3, 4 or 5 wherein the adjustable means are screws.

7. The method of operating a blank forming crank press having a plurality of crank driven punches, dies, stripper sleeves, and transfer means, and means for driving said elements in synchronism, which includes the steps of delivering blanks to the dies, actuating the stripper sleeves to hold the blanks against the dies after the blanks have been delivered, simultaneously retracting the stripper sleeves and punches to a selected height, causing the stripper sleeves to strip the blanks from the punches, and thereafter moving the stripper sleeves away from the blanks.

8. The method according to claim 7 which includes actuating the punches to effect a forming stroke while the blanks are held by the stripper sleeves.

* * * * *